US009144296B2

(12) United States Patent
Lim

(10) Patent No.: US 9,144,296 B2
(45) Date of Patent: Sep. 29, 2015

(54) COLOR-CHANGING COSMETIC INSTRUMENT

(71) Applicant: HCT Packaging, Inc., Bridgewater, NJ (US)

(72) Inventor: Cindy Sean Yuei Lim, Santa Monica, CA (US)

(73) Assignee: HCT PACKAGING, INC., Bridgewater, NJ (US)

( * ) Notice: Subject to any disclaimer, the term of this patent is extended or adjusted under 35 U.S.C. 154(b) by 220 days.

(21) Appl. No.: 13/751,843

(22) Filed: Jan. 28, 2013

(65) Prior Publication Data

US 2013/0312206 A1 Nov. 28, 2013

(51) Int. Cl.

| | |
|---|---|
| ***A46B 5/00*** | (2006.01) |
| ***A46B 3/10*** | (2006.01) |
| ***A46B 15/00*** | (2006.01) |
| ***A45D 33/00*** | (2006.01) |
| ***A45D 34/04*** | (2006.01) |
| ***A45D 40/26*** | (2006.01) |

(52) U.S. Cl.

CPC . *A46B 5/00* (2013.01); *A45D 33/00* (2013.01); *A45D 34/042* (2013.01); *A45D 40/262* (2013.01); *A46B 15/0014* (2013.01); *A46B 15/0085* (2013.01); *A46B 15/0087* (2013.01); *A46B 3/10* (2013.01); *A46B 15/0044* (2013.01); *A46B 2200/1046* (2013.01); *Y10T 29/49826* (2015.01)

(58) Field of Classification Search

CPC .. A46B 15/0014; A46B 15/0044; A46B 3/10; A46B 15/0085; A46B 15/0087; A46B 2200/1046; A45D 34/042; A45D 40/262

USPC ..... 15/143.1, 159.1, 160, 207.2; 132/120, 132/226–236, 308–310, 313

See application file for complete search history.

(56) References Cited

U.S. PATENT DOCUMENTS

| | | | | |
|---|---|---|---|---|
| 4,267,851 | A * | 5/1981 | Plaisted | 132/229 |
| 4,292,986 | A | 10/1981 | Ergaver et al. | |
| 4,479,047 | A * | 10/1984 | Khaja et al. | 219/225 |
| 4,681,791 | A | 7/1987 | Shibahashi et al. | |
| 5,153,066 | A | 10/1992 | Tanaka et al. | |
| 5,316,513 | A | 5/1994 | Nakagawa et al. | |
| 5,334,421 | A | 8/1994 | McNutt | |
| 5,447,167 | A | 9/1995 | Fleischaker | |
| 6,024,101 | A * | 2/2000 | Garner | 132/211 |
| 6,039,051 | A * | 3/2000 | Dorf | 132/313 |
| 6,180,741 | B1 | 1/2001 | Yamaguchi et al. | |
| 6,202,242 | B1 | 3/2001 | Salmon et al. | |
| 6,254,996 | B1 | 7/2001 | Fukuda et al. | |
| 6,401,290 | B1 * | 6/2002 | Barton et al. | 15/143.1 |
| 6,506,327 | B2 | 1/2003 | Weihrauch | |
| 6,596,203 | B1 | 7/2003 | Au et al. | |
| 6,761,969 | B2 | 7/2004 | Li et al. | |

(Continued)

*Primary Examiner* — Mark Spisich
*Assistant Examiner* — Andrew A Horton
(74) *Attorney, Agent, or Firm* — Seager, Tufte & Wickhem LLP

(57) ABSTRACT

A cosmetic instrument for applying a product to a surface includes a handle and an applicator. At least a portion of the cosmetic instrument may change from a first color to a second color in response to occurrence of a condition, such as exposure to electromagnetic radiation (e.g., ultraviolet light or infrared light) or when a temperature of the cosmetic instrument is within a predetermined temperature range. For example, one or more portions of the handle and/or applicator of the cosmetic instrument may be configured to change color in response to the occurrence of the condition.

15 Claims, 3 Drawing Sheets

(56) References Cited

U.S. PATENT DOCUMENTS

| | | | | |
|---|---|---|---|---|
| 6,957,468 | B2 | 10/2005 | Driesen et al. | |
| 7,073,902 | B2 | 7/2006 | Codos et al. | |
| 7,096,598 | B1 | 8/2006 | Myatt | |
| 7,127,770 | B2 * | 10/2006 | Clegg et al. | 15/105 |
| 7,159,950 | B2 | 1/2007 | Young-Chul | |
| 7,448,111 | B2 | 11/2008 | Bigio | |
| 7,727,634 | B2 | 6/2010 | Yacovone | |
| 7,766,440 | B2 | 8/2010 | Kusunoki | |
| 7,866,758 | B2 | 1/2011 | Jang | |
| 8,136,536 | B2 | 3/2012 | Bickford | |
| 2003/0110585 | A1 * | 6/2003 | Rechelbacher | 15/143.1 |
| 2005/0138747 | A1 * | 6/2005 | Su et al. | 15/207.2 |
| 2008/0309017 | A1 | 12/2008 | Mattice | |
| 2009/0003917 | A1 * | 1/2009 | Duncan | 401/6 |
| 2009/0194129 | A1 * | 8/2009 | Junemann | 132/226 |
| 2010/0163071 | A1 * | 7/2010 | Everett et al. | 132/223 |
| 2011/0083690 | A1 * | 4/2011 | Cardenas et al. | 132/120 |
| 2012/0272982 | A1 | 11/2012 | Telwar et al. | |

* cited by examiner

COLOR-CHANGING COSMETIC INSTRUMENT

CROSS-REFERENCE TO RELATED APPLICATION

This application claims priority from Chinese Application No. 201220244497.8, filed May 28, 2012.

BACKGROUND

A cosmetic instrument may include a handle or housing to hold an applicator (e.g., a brush with hairs or bristles, a sponge, flocking, etc.) to apply cosmetic or medicinal products. Both the handle and the applicator may each be manufactured using a color or set of colors that are permanent (e.g., do not change).

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
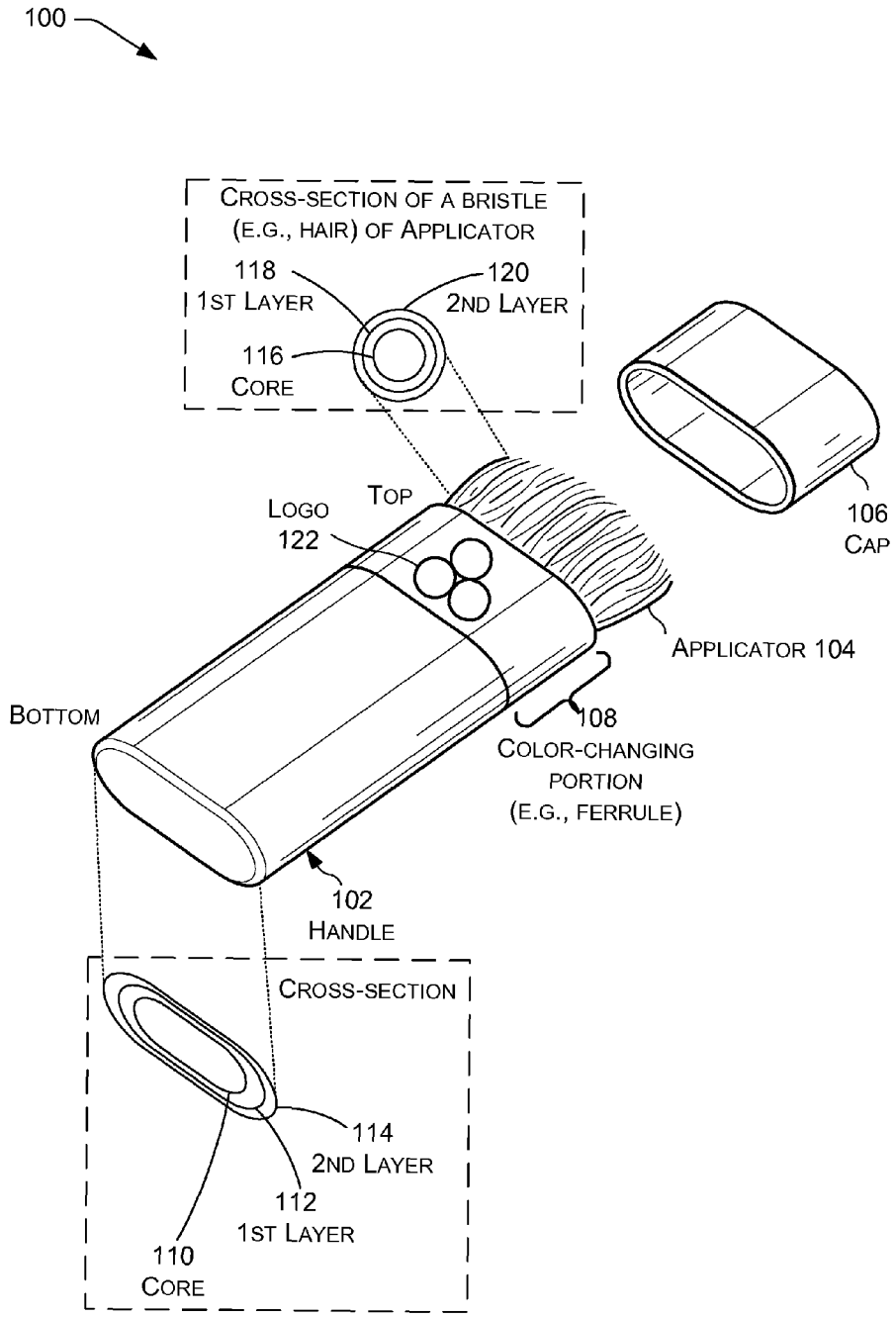
FIG. 1 depicts an illustrative embodiment of a cosmetic instrument that includes a color-changing portion.

This application describes a cosmetic instrument that includes an applicator and a housing (or a handle) where at least a portion of the cosmetic instrument is capable of changing from one color to another color. The cosmetic instrument may include a handle and/or housing to hold an applicator, such as a brush, a sponge, flocking, a comb, pencil, lipstick, or other cosmetic instrument, or any combination thereof. In the case of a brush applicator, the brush may be comprised of multiple hairs or bristles (e.g., strands or filaments or hairs). The cosmetic instrument may be used to apply various products, such as cosmetics and other personal care products. In addition to traditional makeup brushes, the cosmetic instrument may include hair brushes and other personal care items.

In some embodiments, at least a portion of the handle may change color under certain conditions, such as when a temperature associated with a portion of the handle is within a pre-determined temperature range or in the presence of a certain type of electromagnetic radiation (e.g., ultraviolet light). For example, at least a portion of the handle may change from a first color to a second color when a surface of the handle is greater than a threshold temperature or within a predetermined temperature range. As another example, at least a portion of the handle may change from a first color to a second color when exposed to a specific type of light, such as ultraviolet light or infrared light. The light source may be an artificial light source (e.g., blacklight bulb, infra red light bulb) or a natural light source (e.g., sunlight). For example, the portion of the handle that changes color may comprise a solid color, a logo (e.g., a corporate logo), artwork, a message, a unique code (e.g., to determine whether a user associated with the cosmetic instrument has won a prize), etc. When the condition that caused the color change to occur is no longer present (e.g., the electromagnetic radiation is no longer present or the temperature is no longer within the temperature range), the portion of the handle may revert from the second color back to the first color. In some cases, portions of the cosmetic instrument may be capable of changing into three or more colors, with each color associated with a discrete temperature range or activated by a different type of electromagnetic radiation.

In some embodiments, at least a portion of the applicator may change color under certain conditions, such as when a temperature associated with a portion of the applicator satisfies (e.g., is greater than or is less than) a pre-determined threshold or in the presence of a certain type of electromagnetic radiation (e.g., light frequency). For example, at least a portion of the applicator may change from a first color to a second color when a surface of the applicator is greater than a threshold temperature. As another example, at least a portion of the applicator may change from a first color to a second color when exposed to a specific type of light, such as ultraviolet light or infrared light. As yet another example, a first portion of the applicator (e.g., a first set of bristles) may change from a first color to a second color, a second portion of the applicator (e.g., a second set of bristles) may change from the first color to a third color, and so on, resulting in the applicator changing from the first color to one or more additional colors. When the condition that caused the color change to occur is no longer present (e.g., the electromagnetic radiation is no longer present or the temperature is no longer within the temperature range), the portion of the applicator may revert to a previous color from a current color.

The color of at least a portion of the handle or the applicator may change color to provide information to a user of the cosmetic instrument. For example, the color may change to indicate that an amount of ultraviolet radiation received by the cosmetic instrument indicates that the user may consider taking action (e.g., applying sunscreen) to avoid the consequences (e.g., sunburn) of exposure to ultraviolet radiation. As another example, the color may change to indicate that a temperature of the cosmetic instrument indicates that the user may consider taking action (e.g., go to a shaded area) to avoid the consequences (e.g., heat stroke, damage to the cosmetic instrument) of exposure to high temperatures.

In some embodiments, at least a portion of the handle of the cosmetic instrument may change color (e.g., from a first color to a second color) under a first set of conditions (e.g., exposure to a certain type of light or a threshold temperature) and at least a portion of the applicator of the cosmetic instrument may change color (e.g., from a third color to a fourth color) under a second set of conditions (e.g., exposure to a certain type of light or a threshold temperature). For example, applicator bristles of an cosmetic instrument may change from a first color to a second color under ultraviolet radiation and a handle of an cosmetic instrument may change from a third color to a fourth color when a temperature of the handle exceeds a threshold.

The applicator may comprise a group of bristles that are natural (e.g., animal), synthetic (e.g., plastic, silicone, or rubber), or a combination of both. In that case, the bristles may be secured to the handle or housing directly or by a ferrule or other retainer. In other examples, the applicator may comprise a single unit of bristles over-molded to a base of the brush and be formed of one or more of plastic, wood, or metal. For example, the brush may comprise a single unit of shaft-shaped bristles over-molded to the base of the brush, a single unit of blade-shaped bristles over-molded to the base of the brush, or the like.

To enable one or more portions of an cosmetic instrument to change color under certain conditions, the one or more portions of the cosmetic instrument may include a photo-chromatic substance (e.g., a substance that changes color when exposed to certain types of light), a thermo-chromic substance (e.g., a substance that changes color when exposed to one or more types of electromagnetic radiation), another type of substance that changes color, or any combination thereof. The photo-chromatic substance and/or the thermo-chromic substance may be applied to the cosmetic instrument using different techniques, such as spraying, dipping, painting, infusing, silk-screening, or the like. To illustrate, the photo-chromatic substance and/or the thermo-chromic substance may be applied to the cosmetic instrument by heating the core up to or just below its melting point and applying the first layer, or forming the core with a porous outer surface into which the first layer may be "absorbed". For example, at least a portion of the cosmetic instrument may include the first layer of a photo-chromatic substance and/or a thermo-chromic substance. In some cases, a second layer may be applied over the first layer using a sealant or similar substance to protect the first layer from erosion or abrasion. In still other examples, the photo-chromatic and/or thermo-chromatic substances may be molded directly into the handle, housing, and/or applicator of the cosmetic implement. In other words, the photo-chromatic and/or thermo-chromatic substances may be mixed into a resin, plastic, synthetic, or composite material from which the handle, housing, and/or applicator of the cosmetic implement are made.

Thus, at least a portion of a handle, at least a portion of an applicator, or both may change color under certain conditions, such as when a temperature of the portion is within a predetermined range or when the portion is exposed to electromagnetic radiation (e.g., ultraviolet light). The color may change to reveal a logo, artwork, a message (e.g., "apply sunscreen"), a unique code, etc. The changing color may provide a unique experience to a user of the cosmetic instrument as compared to cosmetic instruments that do not change color.

Color-Changing Cosmetic Instrument

FIG. 1 depicts an illustrative embodiment of a cosmetic instrument 100 that includes a color-changing portion. The cosmetic instrument 100 may be used to apply different products to one or more surfaces. For example, the cosmetic instrument 100 may be used to apply different cosmetic or health products, such as blush, foundation, mascara, eye shadow, etc., to a surface, such as a skin of a human being.

The cosmetic instrument 100 includes a handle 102 (e.g., housing) and an applicator 104. The 102 may be formed using one or more natural or man-made materials, such as metal, stone, ceramic, plastic (e.g., acrylic, polypropylene (PP), acrylonitrile butadiene styrene (ABS), or Polyoxymethylene (POM)), glass, wood, or other suitable material. While the handle 102 is illustrated as having a particular shape in FIG. 1, in different implementations the handle 102 may be created in different types of shapes, such as a cylindrical shape, etc. In addition, the cross-section of the handle 102 may be created using different types of geometric shapes, such as a circular cross-section, an oval cross-section, a hexagonal cross-section, and the like.

In FIG. 1, the cosmetic instrument 100 is illustrated as having a brush as the applicator 104. However, in other embodiments, the applicator 104 may include one or more of a brush, a sponge, flocking, a comb, or another type of applicator. The applicator 104 may include a fan-shape, a rectangular-shape, a semi-circular shape, a wedge-shape, another type of geometric-based shape, or any combination thereof. If the applicator 104 includes brushes, in some embodiments, at least one of the brushes may include a few individual larger bristles than the other bristles in the brush.

In some cases, the entire handle 102 may change color, while in other cases one or more portions of the handle 102, such as a color-changing portion 108, may change color. While the color-changing portion 108 is illustrated in FIG. 1 as comprising a ferrule, in some embodiments the color-changing portion 108 may include a bottom portion of the handle 102 and/or a middle portion of the handle 102. In addition, while the color-changing portion 108 is illustrated in FIG. 1 as a single portion, the color-changing portion 108 may include more than one portion. For example, the color-changing portion 108 may include a first portion at the top (e.g., ferrule) of the handle 102 and a second portion at the bottom of the handle 102.

A cross-section of the color-changing portion 108 of the handle 102 may include a core 110 and one or more layers that overlay the core 110, such as a first layer 112 and a second layer 114. While the core 110 is illustrated in FIG. 1 as having two layers (e.g., layers 112 and 114), in some embodiments, the core 110 may have a single layer (e.g., the first layer 112) while in other embodiments the core 110 may have more than two layers. The core 110 may include one or more of metal, stone, ceramic, plastic (e.g., acrylic, polypropylene (PP), acrylonitrile butadiene styrene (ABS), or Polyoxymethylene (POM)), glass, wood, or other suitable material. The core 110 may be clear or may include one or more colors. If the core 110 includes one or more colors, the colors of the core 110 may interact with one or more of the first layer 112 or the second layer 114. For example, the core 110 may include a color (e.g., white or black) that provides a backdrop for the color-changing properties of one or more of the first layer 112 or the second layer 114. As another example, the core 110 may include a color (e.g., red) that interacts with another color (e.g., blue or red) of one or more of the first layer 112 or the second layer 114 to produce a combination color (e.g., red+blue=purple, red+yellow=orange, etc.).

The first layer 112 may include a photo-chromatic substance (e.g., a substance that changes color when exposed to certain types of light), a thermo-chromic substance (e.g., a substance that changes color when exposed to one or more types of electromagnetic radiation), another type of substance that changes color, or any combination thereof. The first layer 112 may be applied to the color-changing portion 108 of the handle 102 using different techniques, such as spraying, dipping, painting, infusing (e.g., plastic infused with a photo-chromatic or a thermo-chromic substance), silk-screening, or the like. To illustrate, the photo-chromatic substance and/or the thermo-chromic substance may be applied to the cosmetic instrument by heating the core 110 up to or just below its melting point and applying the first layer 112, or forming the core 110 with a porous outer surface into which the first layer 112 may be "absorbed".

The second layer 114, if present, may be applied over the first layer 112. In some cases, the second layer 114 may include a sealant substance to protect the first layer 114 (e.g., from erosion or abrasion). The sealant substance may be clear to enable the color-changing of the first layer 112 to be visible. In other cases, the second layer 114 may include a photo-chromatic substance, a thermo-chromic substance, another type of substance that changes color, or any combination thereof. In such cases, the color-changing properties of the second layer 114 may interact with one or more of the color-changing properties of the first layer 112 and/or a color of the core 110. The interaction between one or more of a color of the core 110, a first color of the first layer 112, or a second color of the second layer 114 may cause a logo 122 (e.g., a corporate logo), artwork, a message ("apply sunscreen"), a unique code (e.g., to determine whether a user associated with the cosmetic instrument has won a prize), etc. to be displayed on the color-changing portion 108 of the handle 102.

In FIG. 1, the applicator 104 is illustrated as a brush with multiple bristles (e.g., filaments or hairs). However, the techniques described herein may be used on other types of applicators, such as a comb, flocking, a sponge, and the like. At least a portion of the applicator 104, such as a portion of the bristles, may change color (e.g., from a third color to a fourth color). A cross-section of a portion (e.g., a bristle) of the applicator 104 that changes color may include a core 116 and one or more layers that overlay the core 116, such as a first layer 118 and a second layer 120. The core 116 may be clear or may include one or more colors. If the core 116 includes one or more colors, the colors of the core 116 may interact with one or more of the first layer 118 or the second layer 120. For example, the core 116 may include a color (e.g., white or black) that provides a backdrop for the color-changing properties of one or more of the first layer 118 or the second layer 120. As another example, the core 116 may include a color (e.g., red) that interacts with another color (e.g., blue or red) of one or more of the first layer 118 or the second layer 120 to produce a combination color (e.g., red+blue=purple, red+yellow=orange, etc.).

The first layer 118 may include a photo-chromatic substance (e.g., a substance that changes color when exposed to certain types of light), a thermo-chromic substance (e.g., a substance that changes color when exposed to one or more types of electromagnetic radiation), another type of substance that changes color, or any combination thereof. The first layer 118 may be applied to the bristles of the applicator 104 using one or more techniques, such as spraying, dipping, painting, infusing (e.g., infusing one or more of the bristles with a photo-chromatic or a thermo-chromic substance), silk-screening, or the like.

The second layer 120, if present, may be applied over the first layer 118. In some cases, the second layer 120 may include a sealant substance to protect the first layer 118 (e.g., from erosion or abrasion). The sealant substance may be clear to enable the color-changing of the first layer 118 to be visible. The interaction between one or more of a color of the core 116 and a color of the first layer 118 may cause a combination color to be displayed on one or more portions (e.g., bristles) of the applicator 104. For example, a user viewing the top of the cosmetic instrument 100 may view the logo 122, a pattern, artwork, etc. that is displayed by the color-changing portions (e.g., bristles) of the applicator 104.

The color-changing portion 108 of the handle 102 and/or the color-changing portion (e.g., bristles) of the applicator 104 may change color under pre-determined conditions. For example, when a photo-chromatic substance is used, a color change may occur when the cosmetic instrument 100 is exposed to certain types of electromagnetic radiation (e.g., ultraviolet light or infrared light). As another example, when a thermo-chromic substance is used, a color change may occur when the cosmetic instrument 100 reaches a temperature that is within a predetermined temperature range.

In some embodiments, the cap 106 may include a core (e.g., similar to the core 110 of the handle 102) and one or more layers (e.g., similar to the layers 112 or 114 of the handle 102) to enable the cap 106 to change from a fifth color to a sixth color. For example, the cap 106 may include a first layer of a photo-chromatic that changes color in response to exposure to a particular type of electromagnetic radiation or a layer of a thermo-chromic substance that changes color in response to exposure to a particular temperature range. In some cases, the cap 106 may include a second layer of a sealant substance to protect the first layer.

The cosmetic instrument 100 may be deployed for different purposes. For example, the color-changing properties of the cosmetic instrument 100 may provide a novel experience to a user, who may enjoy watching the cosmetic instrument 100 change colors. As another example, each cosmetic instrument may have a unique code that is displayed under certain conditions and at least some of the unique codes may have an associated prize or reward. To illustrate, a company may offer prizes to users as an incentive to purchase a product that includes a cosmetic instrument. After purchasing the product, a user may expose the cosmetic instrument to electromagnetic radiation (e.g., an ultraviolet lamp provided by a retailer) to determine whether the user has won a prize. As yet another example, the color-changing properties of the cosmetic instrument 100 may alert a user to perform an action. For example, the cosmetic instrument 100 may change colors (or display a message, the logo 122, etc.) to indicate that an amount of ultraviolet rays reaching the cosmetic instrument 100 indicate that the user should take suitable precautions (e.g., apply sunscreen, wear a hat, move to a shaded area) to avoid injury (e.g., sunburn) resulting from too much exposure to a particular type of electromagnetic radiation. As another example, the cosmetic instrument 100 may change colors (or display a message, the logo 122, etc.) to indicate that a temperature of the cosmetic instrument 100 indicates that the user should take suitable precautions (e.g., move to a shaded area) avoid injury (e.g., heat stroke) resulting from exposure to a predetermined temperature range (or temperatures greater than a predetermined threshold).

Thus, the color-changing portion 108 of the handle 102, at least a portion of the applicator 104, or both may change color under certain conditions, such as when a temperature of the portion is within a predetermined range or when the portion is exposed to electromagnetic radiation (e.g., ultraviolet light). The color may change to reveal a logo (e.g., the logo 122), artwork, a message, a unique code, etc. When the condition (e.g., electromagnetic radiation or temperature range) that caused a color of at least a portion of the cosmetic instrument 100 to change is no longer present, the portion of the cosmetic instrument 100 that change from a first color to a second color may change back from the second color to the first color. The changing color may provide a unique experience to a user of the cosmetic instrument 100 as compared to cosmetic instruments that do not change color.

Figure 2:
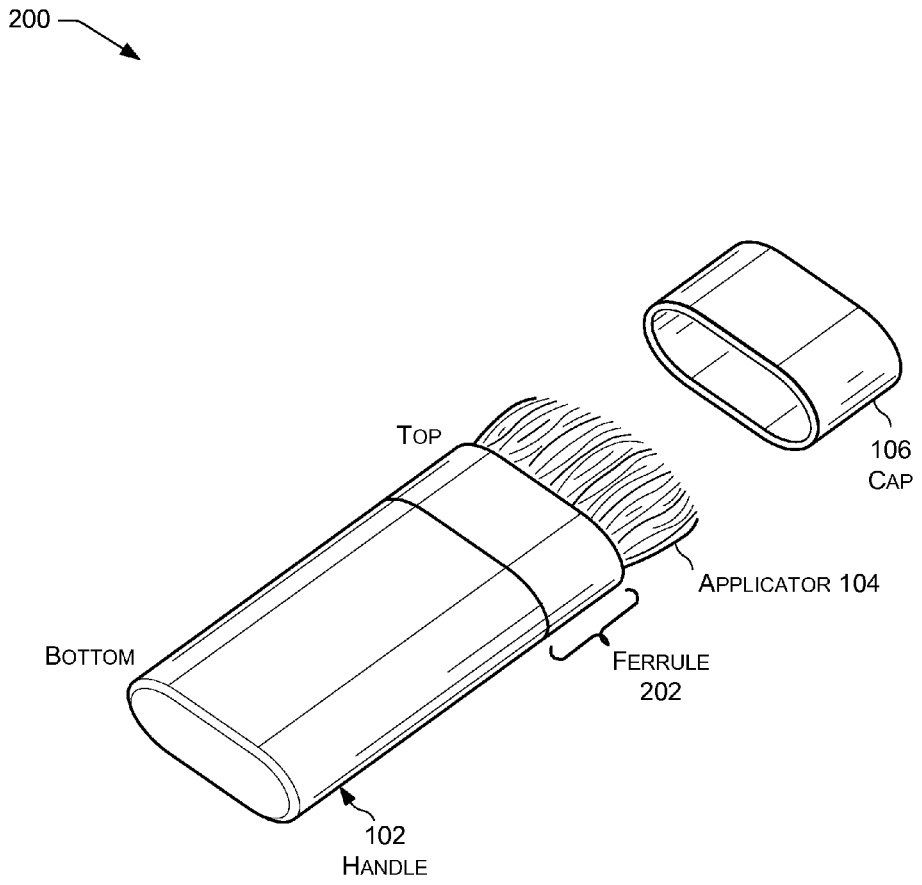
FIG. 2 depicts an illustrative embodiment of a cosmetic instrument that includes a ferrule.

FIG. 2 depicts an illustrative embodiment of a cosmetic instrument 200 that includes a ferrule. The cosmetic instrument 200 may be used to apply different products to one or more surfaces. For example, the color-changing cosmetic instrument 200 may be used to apply different cosmetic or health products, such as blush, foundation, mascara, eye shadow, etc., to a surface, such as a skin of a human being.

The cosmetic instrument 200 includes the handle 102 and the applicator 104. The handle 102 may be formed using one or more natural or man-made materials, such as metal, stone, ceramic, plastic (e.g., acrylic, polypropylene (PP), acrylonitrile butadiene styrene (ABS), or Polyoxymethylene (POM)), glass, wood, or other suitable material.

In FIG. 2, the cosmetic instrument 100 is illustrated as having a brush as the applicator 104. However, in other embodiments, the applicator 104 may include one or more of a brush, a sponge, flocking, a comb, or another type of applicator. The applicator 104 may include a fan-shape, a rectangular-shape, a semi-circular shape, a wedge-shape, another type of geometric-based shape, or any combination thereof. If the applicator 104 includes brushes, in some embodiments, at least one of the brushes may include a few individual larger bristles than the other bristles in the brush.

In some cases, the entire handle 102 may change color, while in other cases one or more portions of the handle 102, may change color. For example, a ferrule 202 may change color or a portion of the handle 102 excluding the ferrule 202, may change color.

Figure 3:
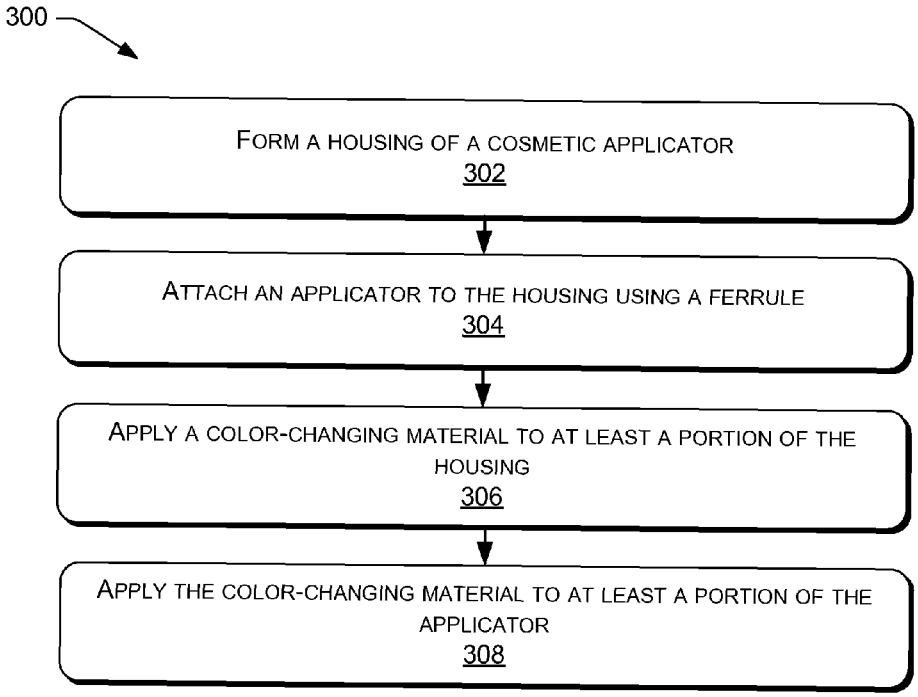
FIG. 3 is a flow diagram of an illustrative process for creating the color-changing applicator of FIG. 1.

FIG. 3 is a flow diagram of an illustrative process 300 for creating the cosmetic instrument 100 of FIG. 1 or the cosmetic instrument 200 of FIG. 2. In the process 300, each block represents one or more operations that can be implemented when manufacturing a cosmetic instrument, such as the cosmetic instrument 100 or 200. The order in which the blocks are described is not intended to be construed as a limitation, and any number of the described operations can be combined in any order and/or in parallel to implement the processes. For discussion purposes, the process 300 is described with reference to the color-changing applicators 100 and 200 as described above.

At 302, a handle for a cosmetic instrument may be formed. For example, the handle 102 of the cosmetic instrument 100 of FIG. 1 or the handle 102 of the cosmetic instrument 200 of FIG. 2 may be formed.

At 304, an applicator may be attached to the handle using a ferrule. For example, in FIG. 2, the applicator 104 may be attached to the handle 102 using the ferrule 202. The applicator may include one or more of a brush (e.g., a set of bristles or hairs), flocking, a sponge, a comb, or another type of applicator. The applicator may be used to apply cosmetic or medicinal products to surfaces, such as human skin.

At 306, a color-changing material may be applied to at least a portion of the handle. For example, in FIG. 1 or FIG. 2, a color-changing material may be applied to at least a portion of the handle 102 (e.g., the logo 122 or the ferrule 202). The color-changing material may change from a first color to second color in response to exposure of the portion to electromagnetic radiation (e.g., ultraviolet or infrared light) or in response to the portion reaching a temperature within a predetermined temperature range.

The portion of the cosmetic instrument 100 or 200 that changes color may include a photo-chromatic substance or thermo-chromic substance. The photo-chromatic substance or thermo-chromic substance may be applied as a layer to the portion of the cosmetic instrument by painting, spraying, dipping, silk screening, or infusing the portion of the cosmetic instrument with the photo-chromatic substance or thermo-chromic substance. In some cases, the change in color may cause a message, artwork, a logo, a code, a graphic symbol, or the like to be displayed on the cosmetic instrument. After the portion of the cosmetic instrument is no longer exposed to the electromagnetic radiation or the temperature of the portion is no longer within the predetermined temperature range, the color of the portion may change back from the second color to the first color.

At 308, the color-changing material may be applied to at least a portion of the applicator. For example, in FIG. 1 or FIG. 2, a color-changing material may be applied to at least a portion of the applicator 104. The color-changing material may change from a first color to second color in response to exposure of the portion to electromagnetic radiation (e.g., ultraviolet or infrared light) or in response to the portion reaching a temperature within a predetermined temperature range. The portion of the cosmetic instrument 100 or 200 that changes color may include a photo-chromatic substance or thermo-chromic substance. The photo-chromatic substance or thermo-chromic substance may be applied as a layer to the portion of the cosmetic instrument by painting, spraying, dipping, silk screening, or infusing the portion of the cosmetic instrument with the photo-chromatic substance or thermo-chromic substance. To illustrate, in FIG. 1, the photo-chromatic substance and/or the thermo-chromic substance may be applied to the cosmetic instrument 100 by heating the core 110 up to or just below its melting point and applying the first layer 112, or forming the core 110 with a porous outer surface into which the first layer 112 may be "absorbed".

In some implementations, the color-changing material may be applied to at least a portion of the handle, at least a portion of the applicator, or both. In addition, in some cases, the color-changing material may be applied before the applicator is attached to the handle, at 304. For example, the color-changing material may be applied to the handle and/or to the applicator before or after the applicator is attached to the handle.

Thus, a cosmetic instrument may provide enjoyment to a user of the cosmetic instrument by one or more portions of the cosmetic instrument changing colors based on various conditions, such as exposure to certain types of electromagnetic radiation or when a temperature of a portion of the cosmetic instrument is within a predetermined temperature range. The color-changing property of the cosmetic instrument may be created by applying a first layer of a photo-chromatic substance or a thermo-chromic substance to one or more portions of the cosmetic instrument (e.g., one or more portions of the handle, the applicator, or the cap). In some cases, a sealant layer may be applied over the first layer to protect the first layer.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely. For example, the shape, size, and configuration of the split-tip applicator, applicators, locking mechanism, and slide mechanisms may be varied.

What is claimed is:

1. A cosmetic instrument system comprising:

a handle, the handle comprising:

a core;

a first photochromic layer over at least a portion of the core to enable the first photochromic layer to change from a first color to a second color in response to a first light; and a second photochromic layer over at least a portion of the first photochromic layer to enable the second photochromic layer to change from a first color to a third color in response to a second light;

a ferrule affixed to a top of the handle; and a brush comprising a group of bristles, the brush affixed to a top of the handle using the ferrule;

wherein the first photochromic layer and the second photochromic layer enable the handle to change from a first color to a fourth color in response to a third light.

2. The cosmetic instrument system according to claim 1, wherein one of the first light or the second light comprises ultraviolet light and the other of the first light or the second light comprises infrared light.

3. The cosmetic instrument system according to claim 1, wherein the ferrule is capable of changing from the first color to the second color in response to light.

4. The cosmetic instrument system according to claim 1, wherein one or more of the first photochromic layer and the second photochromic layer is applied to the core by one or more of spraying the core, dipping the core, painting the core, infusing the core, or silk-screening the core.

5. The cosmetic instrument system according to claim 1, wherein the handle further comprises a third layer over the second photochromic layer, the third layer comprising a sealant to protect the second photochromic layer.

6. The cosmetic instrument system according to claim 1, wherein:

one or more bristles of the group of bristles are configured to change from a fourth color to a fifth color in response to a predetermined condition occurring.

7. The cosmetic instrument system according to claim 6, wherein:

the one or more bristles of the group of bristles include a photo-chromatic substance; and the one or more bristles change from the fourth color to the fifth color in response to exposure to light.

8. The cosmetic instrument system according to claim 6, Wherein:

the one or more bristles of the group of bristles include a thermo-chromic substance; and the one or more bristles change from the fourth color to the fifth color when a temperature of the cosmetic instrument system is within a predetermined temperature range.

9. An cosmetic instrument comprising:

a handle;

a ferrule; and an applicator affixed to a top of the handle using the ferrule, wherein at least one of a portion of the handle, a portion of the ferrule, or a portion of the applicator is configured to change from a first color to a second color in response to occurrence of a condition;

wherein the handle comprises a core, a first layer, and a second layer; and wherein the first layer and the second layer are each applied over at least a portion of the core;

wherein one of the first layer or the second layer includes a photo-chromatic substance and the condition comprises exposure to light; and wherein the other of the first layer or the second layer include a thermo-chromic substance and the condition comprises exposure to a temperature within a particular temperature range.

10. The cosmetic instrument according to claim 9, wherein at least a portion of the applicator comprises an additional core and the second layer is applied over the additional core.

11. The cosmetic instrument according to claim 10, wherein:

when the second layer includes a photo-chromatic substance, the condition comprises exposure to light; and when the second layer includes a thermo-chromic substance, the condition comprises exposure to a temperature within a predetermined temperature range.

12. A method comprising:

forming a handle of a cosmetic instrument;

attaching an applicator to the handle using a ferrule;

applying a first color changing material to at least a portion of the cosmetic instrument to enable the portion of the cosmetic instrument to change from a first color to a second color in response to occurrence of a first condition; and applying a second color changing material to at least a portion of the cosmetic instrument to enable the portion of the cosmetic instrument to change from the first color to a third color in response to occurrence of a second condition;

wherein the first color changing material and the second color changing material enable the portion of the cosmetic instrument to change from the first color to a fourth color in response to occurrence of a third condition.

13. The method according to claim 12, wherein:

the portion of the cosmetic instrument changes from the first color to the second color in response to:

exposure to light, or exposure to a temperature within a pre-determined temperature range.

14. The method according to claim 12, wherein one or more of the first color changing material and the second color changing material is applied to at least the portion of the cosmetic instrument by one or more of spraying the portion of the cosmetic instrument, dipping the portion of the cosmetic instrument, painting the portion of the cosmetic instrument, infusing the portion of the cosmetic instrument, or silk-screening the portion of the cosmetic instrument.

15. The method according to claim 12, wherein the third condition comprises the occurrence of the first condition and the second condition at the same time.

* * * * *